US005634254A

United States Patent [19]

Calmettes et al.

[11] Patent Number: 5,634,254

[45] Date of Patent: Jun. 3, 1997

[54] METHOD FOR MANUFACTURING SWAGING RINGS

[75] Inventors: Lionel Calmettes, Romorantin; Pascal Detable, Gievres; Michel Andre, Lanthenay, all of France

[73] Assignee: Etablissements Caillau, Issy Les Moulineaux, France

[21] Appl. No.: 452,833

[22] Filed: May 30, 1995

Related U.S. Application Data

[62] Division of Ser. No. 182,938, Jan. 18, 1994, Pat. No. 5,469,604.

[30] Foreign Application Priority Data

Feb. 1, 1993 [FR] France ..... 9301053

[51] Int. Cl.[6] ..... B23P 11/00

[52] U.S. Cl. ..... 29/417; 29/524.1; 29/525.06

[58] Field of Search ..... 29/417, 524.1, 29/525.05, 525.06; 24/21, 22, 20 CW, 20 R, 23 R, 23 W, 23 EE, 20 TT, 20 EE; 16/108

[56] References Cited

U.S. PATENT DOCUMENTS 1,360,792 11/1920 Prendergast .
1,508,570 9/1924 Norton .
1,703,866 3/1929 Bowman ..... 29/525.06
2,738,747 3/1956 Derrick .
3,365,775 1/1968 Cavagnero ..... 29/417 X

*Primary Examiner*—S. Thomas Hughes
*Attorney, Agent, or Firm*—Marshall & Melhorn

[57] ABSTRACT

A method for manufacturing a ring for swaging from a continuous metal strip includes stamping strip ends to about one-half the thickness of the metal strip. Studs are formed on the ends of the strip. The displaced metal is trimmed from the ends to maintain a uniform width. The strip of metal is cut between adjacent strip ends. The strip is then rolled until the ends of the metal strip are abutted, the compressed strip ends forming a housing for receiving a plate. Plates are fabricated to fit in the housing. Each plate includes corresponding holes for receiving the studs on the strip ends. The studs are riveted in the holes to secure the ring. The holes may be formed on the strip ends and the plate can be formed with studs to secure the ring.

12 Claims, 1 Drawing Sheet

METHOD FOR MANUFACTURING SWAGING RINGS

This application is a divisional application of U.S. patent application Ser. No. 08/182,938 filed Jan. 18, 1994, now U.S. Pat. No. 5,469,604.

FIELD OF THE INVENTION

It is known that in numerous cases two tubular elements fitted one within the other are fastened together by means of a closed annular ring which, after being put into place on the outer tubular element in a zone overlying the inner tubular element, is subjected to a swaging operation in order to clamp the two tubular elements together appropriately.

BACKGROUND OF THE INVENTION

Such rings for swaging are presently obtained by various methods.

By way of example, mention is made of the technique consisting in pressing a plane metal ring and then subsequently in cutting out the plane portion that subsists after the stamping operation. In addition to being relatively lengthy, such a method leads to a considerable loss of metal during the cutting-out operation and thus leads to the ring for swaging being excessively expensive.

It is also mentioned that rings for swaging can be obtained by slicing off suitable widths from a tube made of a sheet of metal that has been rolled into a tube and welded together along a generator line of said tube. That method is also not very satisfactory. Not only does it take a relatively long time because of the slicing, but in addition it requires prior manufacture of the tube, thereby also leading to rings for swaging that are prohibitively expensive.

Subsequent to the development of the two above-mentioned methods, the idea came about that rings for swaging could be made from a metal strip of width corresponding to the width desired for the ring. A length of strip is cut off and rolled up, and its two ends are bonded together without giving rise to significant extra thickness in the bonding zone, since that could disturb the subsequent swaging operation.

To this end, proposals have been made to butt-weld the two ends of the length of strip together after it has been rolled up. However, that operation generally cannot be performed automatically on the machines used for cutting off the lengths of strip and for rolling them up. That gives rise to a discontinuity in the manufacturing process, and also to certain fragility in the weld zone. More seriously, the need for a welding operation makes it impossible to use a strip of metal that has been treated appropriately for the subsequent swaging operation. The treatment in question must nevertheless be performed after the ring has been fabricated, and as a result the cost of the ring is likewise prohibitive.

Still in the context of fabrication from a metal strip, a final idea has been to cut out complementary shapes in the ends of a length of strip, e.g. T-shapes, which shapes are suitable for being engaged one within the other, said shapes being prevented from relative movement in the radial direction by welding, as before, in general by welding together the ends of the horizontal bar of the T-shape. However, in addition to the drawbacks mentioned above that result from the need to perform a welding operation, it is observed during the swaging operation that unacceptable deformations often occur on rings made by the above method.

The Applicant has therefore had the idea of implementing rings for swaging without any welding operation, thereby avoiding the drawbacks of known rings, in particular rings obtained by the first above-mentioned method. To this end, the Applicant proposes implementing methods that require only operations of pressing and/or stamping, cutting out, and/or folding that are suitable for being automated. Furthermore, the lack of any welding makes it possible to use a strip of metal that has been appropriately treated for the subsequent swaging operation, thereby contributing to a considerable reduction in the time required for fabricating a ring, and consequently reducing its cost price.

OBJECTS AND SUMMARY OF THE INVENTION

A first object of the invention is therefore a novel ring for swaging made from a length of metal strip that is rolled up.

According to the invention, the ends of the rolled-up length of strip are disposed substantially in contact with each other along their terminal edges. The thickness of each of the two ends is close to one-half the thickness of the strip and their inner (or outer) faces are offset outwardly (or inwardly) relative to the inside (or outside) surface of the ring. Thus, a housing is constituted suitable for receiving a plate whose thickness is close to half the thickness of the strip. A set of complementary studs and holes is provided on the ends of the strip and on the plate, said studs being engaged in the holes and the free ends of the studs being riveted to the element (plate or end of the strip) opposite from the element carrying them.

The invention also provides a method of fabricating rings for swaging as defined above, in which method two ends of two rings are implemented simultaneously by pressing and/or stamping in a continuous metal strip, each of the ends being formed together with at least one stud (or at least one hole), after which the axially extreme terminal edges of said ends are cut simultaneously.

Because of these dispositions taken together, the usual requirements of no significant extra thickness in the bond zone between the ends of the length of strip are satisfied while avoiding or limiting losses of metal, and, in particular because of the existence of the plate, said bond zone is of sufficient strength to avoid any risk of unacceptable deformation occurring during the operation of swaging the ring. In this respect, it may be observed that the plate may easily be made of a material that is different from that used for the strip, e.g. a material of greater mechanical strength than the material of the strip. Furthermore, it has been observed that because of the invention the direct cost (materials cost plus labor cost) of fabricating a ring to be swaged can be divided by three or even by five relative to the cost of known techniques, other things remaining equal.

BRIEF DESCRIPTION OF THE DRAWINGS

The invention will be better understood and its advantages together with various secondary characteristics will appear on reading the following description of a particular embodiment. To this end, reference is made to the accompanying drawing, in which.

MORE DETAILED DESCRIPTION

Figure 1:
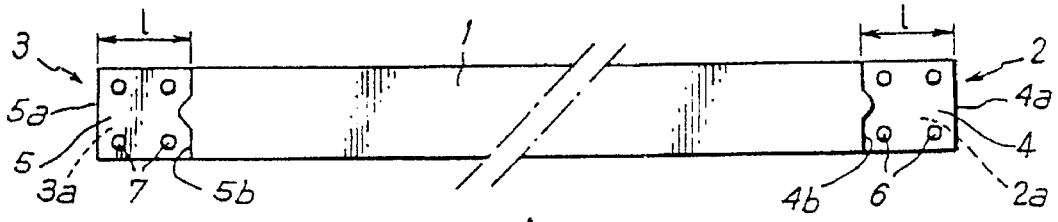
FIG. 1 is a plan view of a length of metal strip after the pressing and/or stamping operation for forming its ends.
Figure 2:
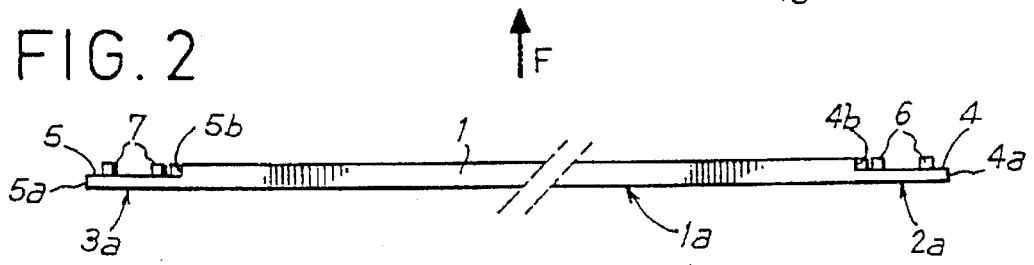
FIG. 2 is a view along arrow F in FIG. 1.

If reference is made initially to FIGS. 1 and 2, it can be seen that a metal strip 1 has two ends designated by respective overall references 2 and 3. It is mentioned at this point, with reference to FIG. 4, that when the length of strip 1 is rolled up, the bottom faces 2*a* and 3*a* (in FIGS. 1 and 2) of the ends 2 and 3 are in correspondence with each other so as to form the outside surface of the ring, and their terminal edges come substantially into contact with each other. The term "outside face" is used below to designate the bottom faces 2*a* and 3*a* (in FIG. 2) of the ends 2 and 3, while the term "inside face" is used for the opposite faces thereof.

The reader will already have understood, and it will become even more clear below, that the "inside face" of each end could equally well be constituted by a bottom face 2*a* or 3*a*, in which case the "outside face" would still be the face opposite thereto. Nevertheless, to simplify the following description, only the embodiment shown in the figures is described, i.e. the embodiment in which the strip is rolled up to make a ring for swaging in the configuration shown in FIGS. 4 and 5.

Returning to FIGS. 1 and 2, it can be seen that the ends 2 and 3 are of substantially equal axial length l, and have thickness (as clearly visible in FIG. 2) equal to no more than half the thickness of the strip 1.

The outside faces 2*a* and 3*a* of the ends 2 and 3 are continuous with the outside surface 1*a* of the future ring, whereas their inside faces are given respective references 4 and 5.

Four cylindrical or prismatic studs 6 project from the inside face 4 of the end 2, the axes of the studs being perpendicular to the inside face and the height of the studs being not less than half the thickness of the strip 1. Similarly, four studs 7 analogous to the studs 6 project from the inside face 5 of the end 3, and the studs 7 are preferably identical to the studs 6 and are disposed in the same manner. Nevertheless, it should be observed that the number of studs on each end is not set by the invention.

The axially terminal edges 4*a* and 5*a* of the ends 2 and 3, or more precisely of their inside faces 4 and 5, are perpendicular to the axis of the strip 1. Nevertheless, as shown in FIGS. 1 and 2, the internal terminal edges 4*b* and 5*b* of the inside faces are advantageously not rectilinear in profile, preferably having an axial projection for a purpose that is explained below.

Given the length of strip 1 and the structure of its ends 2 and 3 as described above, a ring for swaging is obtained by rolling up the length of strip 1 (FIG. 4), as already mentioned. The terminal edges 4*a* and 5*a* of the two ends 2 and 3 then come substantially into contact with each other, and the two ends are bonded together in the peripheral direction of the ring by means of a plate 8 that can be seen in FIG. 3.

The plate 8 is substantially rectangular in shape, having the same width as the strip 1 and having thickness close to one-half the thickness of the strip. Its own length is substantially equal to 2l, i.e. to twice the axial length of each of the ends 2 and 3. Its terminal edges 8*a* are not rectilinear in profile, being complementary to the internal terminal edges 4*b* and 5*b* of the inside faces 4 and 5 of the two ends of the strip. Finally, two sets of four holes 9 and 10 are formed in the plate 8, the diameter and the relative disposition of the holes being complementary to the diameter and the relative disposition of the two sets of studs 6 and 7 on the ends 2 and 3.

Figure 4:
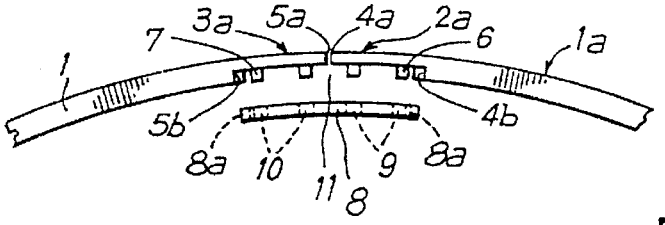
FIG. 4 is a fragmentary elevation view of a ring prior to the two ends of the length of strip constituting the ring being bonded together.
Figure 5:
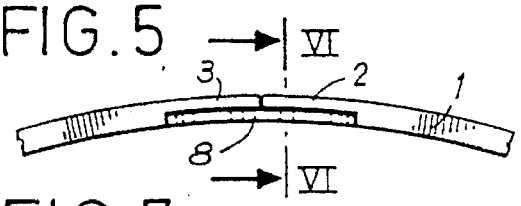
FIG. 5 is a fragmentary elevation view of a ring after the two ends of the length of strip constituting the ring have been bonded together.
Figure 6:
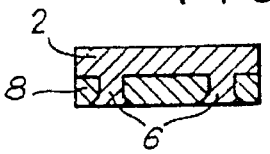
FIG. 6 is a section on a radial plane through the ring (on VI—VI of FIG. 5) in the zone where the two ends of the length of strip are bonded together.

After the strip 1 has been rolled up, and as shown in FIG. 4, the ends 2 and 3 constitute a housing 11 for receiving the plate 8, in which case the studs 6 and 7 penetrate into the holes 9 and 10. The free ends of the studs are riveted against the face of the plate 8 that extends the inside surface of the ring (FIG. 5) and this fixing of the plate together with the co-operation between the complementary profiles of its terminal edges 8*a* and the terminal edges 4*b* and 5*b* of the housing 11 ensure perfect continuity of the ring and good strength.

It is mentioned at this point that the plate 8 is advantageously made of the same material as the strip, but that it has been subjected to appropriate treatment such as work hardening so as to cause its mechanical strength (or its hardness) preferably to be twice that of the material from the strip is made. In any event, regardless of the nature of the plate material and its relative strength compared with that of the strip material, it is easy to define the depth of the housing 11 and the corresponding thickness of the plate 8 so as to obtain the desired mechanical characteristics for the bond between the two ends 2 and 3 of the strip 1.

The ring for swaging is then completed and ready for use, with the operations of pressing and/or stamping and of riveting having had no effect on the properties of the metal chosen for the length of strip 1 as a function of its subsequent use in a swaging operation, and nevertheless the bond zone between the ends of the strip possesses bending strength and compression strength that are not less than the corresponding strengths of the remainder of the strip.

Figure 7:
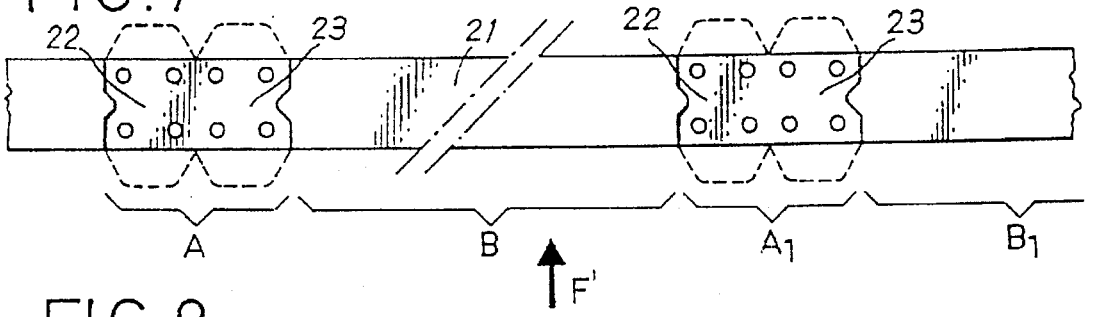
FIG. 7 is a fragmentary plan view of a metal strip during the process of fabricating rings of the invention.
Figure 8:
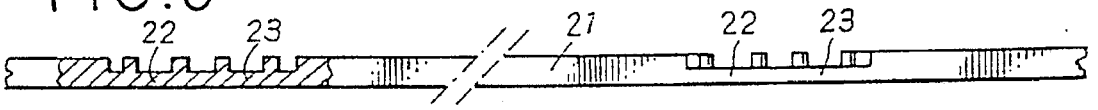
FIG. 8 is a partially cutaway view of the strip shown in FIG. 7 as seen along F' therein.

With reference to FIGS. 7 and 8, the main characteristics of the method enabling a ring for swaging of the type described above to be fabricated quickly and cheaply are now described, insofar as they have not already occurred to the person skilled in the art.

Starting with a strip 21 of appropriate metal suitably treated for its subsequent use, a pressing and/or stamping operation is used to form simultaneously a group that is given reference A and that is constituted by an end 22 of one ring and by an end 23 of another ring. Naturally, each of these ends has the structure described above, and in particular its thickness is no greater than half the thickness of the strip.

During the above operation, metal from the strip is urged out sideways from the ends 22 and 23 as can clearly be seen in FIG. 7. In a subsequent stage of the method, the metal displaced from the edges of the ends 22 and 23 (as represented by dashed lines) is removed, e.g. by being cut off, so as to ensure that the ends are of the same width as the strip 21.

Once at least two consecutive groups such as A and $A_1$ have been made, thereby leaving between them suitable lengths of strip B, $B_1$, . . . corresponding to the circumference desired for the rings to be swaged, it is preferable, prior to rolling up each length of strip B situated between two groups A and $A_1$, to cut out the two extreme terminal edges of the length B simultaneously, i.e. each cut is performed substantially in the middle of a portion A and $A_1$.

Figure 3:
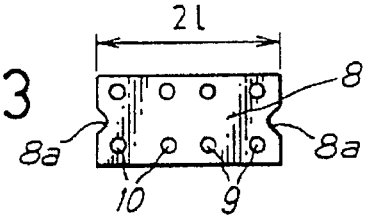
FIG. 3 is a plan view of a plate for bonding together the two ends of the strip.

After the length of strip B has been fully rolled up, its ends 22 and 23 are assembled together as described above with reference to FIGS. 4 and 5 by means of a previously prepared plate of the type described with reference to FIG. 3.

Nevertheless, it may be preferred to begin by fixing the plates to one of the ends of the strip by riveting the corresponding studs, and then to proceed by rolling up the strip so as to terminate the ring by fixing the plate to the other end by riveting the corresponding studs.

Although the description of the ring for swaging and of its method of manufacture has been given on the assumption that the studs 6 and 7 are disposed on the ends 2 and 3 of the length of strip 1 while the holes 9 and 10 are in the plate, it is clear that the configuration could be inverted, without going beyond the scope of the invention. It is also possible to envisage placing a set of holes and a set of studs on a plate 8 and placing complementary sets of studs and holes on the ends 2 and 3 of the length of strip 1.

We claim:

1. A method for manufacturing a plurality of swaging rings from a continuous strip of metal comprising the steps of:

a) feeding a first end of a metal strip into a stamping press;

b) stamping the metal strip to form a compressed strip end of a first ring and an adjacent compressed strip end of a second ring, the stamping operation compressing each strip end to about one-half the thickness of the metal strip and forming at least two studs on each compressed end;

c) trimming the displaced metal from the edges of the compressed strip ends such that the compressed strip ends are the same width as the metal strip;

d) cutting the metal strip between the compressed strip end of a first ring and the adjacent compressed strip end of a second ring;

e) feeding a length of the metal strip into the stamping press, the length of the metal strip corresponding to a circumference of the rings to be swaged;

f) repeating steps a–e to form a plurality of metal strips having compressed ends with studs;

g) forming a plurality of plates, each for securing the compressed strip ends of each metal strip, said plates having the same width and about one-half the thickness of the metal strip and including corresponding holes for receiving the studs of the compressed strip ends;

h) rolling each of the metal strips until the compressed strip ends of a respective metal strip are abutted to form a housing for receiving the plate;

i) inserting the plate into the housing and riveting the studs into the holes to form a swaging ring; and j) repeating steps h and i to form a plurality of swaging rings.

2. A method for manufacturing a plurality of swaging rings from a continuous strip of metal comprising the steps of:

a) feeding a first end of a metal strip into a stamping press;

b) stamping the metal strip to form a compressed strip end of a first ring and an adjacent compressed strip end of a second ring, the stamping operation compressing each strip end to about one-half the thickness of the metal strip and forming at least two interlocking means on each compressed end;

c) trimming the displaced metal from the edges of the compressed strip ends such that the compressed strip ends are the same width as the metal strip;

d) cutting the metal strip between the compressed strip end of a first ring and the adjacent compressed strip end of a second ring;

e) feeding a length of the metal strip into the stamping press, the length of the metal strip corresponding to a circumference of the ring to be swaged;

f) repeating steps a–e to form a plurality of metal strips having compressed ends with interlocking means;

g) forming a plurality of plates, each for securing the compressed strip ends of each metal strip, said plates having the same width and about one-half the thickness of the metal strip and including complementary interlocking means for receiving the interlocking means of the compressed strip ends;

h) rolling each of the metal strips until the compressed strip ends of a respective metal strip are abutted to form a housing for receiving the plate;

I) inserting the plate into the housing and securing the interlocking means of the compressed strip end into the complementary interlocking means of the plate to form a swaging ring; and j) repeating steps h and i to form a plurality of swaging rings.

3. The method for manufacturing swaging rings defined in claim 2, wherein the interlocking means formed in the compressed strip end are studs and the complementary interlocking means formed in the plate are holes.

4. The method for manufacturing swaging rings defined in claim 3, wherein securing the interlocking means includes riveting the studs of the compressed strip end into the holes of the plate.

5. The method for manufacturing swaging rings defined in claim 2, wherein the interlocking means formed in the compressed strip end are holes and the complementary interlocking means formed in the plate are studs.

6. The method for manufacturing swaging rings defined in claim 5, wherein securing the interlocking means includes riveting the studs of the plate into the holes of the compressed strip end.

7. The method for manufacturing swaging rings defined in claim 2, including the additional step of treating the plate to increase the hardness of the plate prior to inserting the plate into the housing.

8. A method for manufacturing a plurality of swaging rings from a continuous strip of metal comprising the steps of:

a) feeding a first end of a metal strip into a stamping press;

b) stamping the metal strip to form a compressed strip end of a first ring and an adjacent compressed strip end of a second ring, the stamping operation compressing each strip end to about one-half the thickness of the metal strip and forming at least two interlocking means on each compressed end;

c) trimming the displaced metal from the edges of the compressed strip ends such that the compressed strip ends are the same width as the metal strip;

d) cutting the metal strip between the compressed strip end of a first ring and the adjacent compressed strip end of a second ring;

e) feeding a length of the metal strip into the stamping press, the length of the metal strip corresponding to a circumference of the ring to be swaged;

f) repeating steps a–e to form a plurality of metal strips having compressed ends with interlocking means;

g) forming a plurality of plates, each for securing the compressed strip ends of each metal strip, said plates having the same width and about one-half the thickness of the metal strip and including complementary interlocking means for receiving the interlocking means of the compressed strip ends;

h) securing the complementary interlocking means of a plate to the interlocking means to a first compressed strip end of a respective metal strip;

I) rolling the metal strip until the first compressed strip end is abutted to a second compressed strip end of the metal strip;

j) securing the interlocking means of the second compressed strip end into the complementary interlocking means of the plate to form a swaging ring; and k) repeating steps h through j to form a plurality of swaging rings.

9. The method for manufacturing swaging rings defined in claim 8, wherein the interlocking means formed in the compressed strip end are studs and the complementary interlocking means formed in the plate are holes.

10. The method for manufacturing swaging rings defined in claim 9, wherein the steps of securing the interlocking means includes riveting the studs of the compressed strip ends into the holes of the plate.

11. The method for manufacturing swaging rings defined in claim 9, wherein the interlocking means formed in the compressed strip end are holes and the complementary interlocking means formed in the plate are studs.

12. The method for manufacturing swaging rings defined in claim 11, wherein the steps of securing the interlocking means includes riveting the studs of the plate into the holes of the compressed strip end.

* * * * *